US007854102B2

(12) United States Patent
Zappa

(10) Patent No.: US 7,854,102 B2
(45) Date of Patent: Dec. 21, 2010

(54) PANEL FOR LIFT DOORS

(75) Inventor: Roberto Zappa, Bergamo (IT)

(73) Assignee: Sematic Italia S.p.A., Bergamo (IT)

( * ) Notice: Subject to any disclaimer, the term of this patent is extended or adjusted under 35 U.S.C. 154(b) by 267 days.

(21) Appl. No.: 11/731,123

(22) Filed: Mar. 30, 2007

(65) Prior Publication Data

US 2007/0256374 A1 Nov. 8, 2007

(30) Foreign Application Priority Data

Apr. 21, 2006 (IT) ..... BG20060012 U

(51) Int. Cl.

| | |
|---|---|
| ***E04C 2/54*** | (2006.01) |
| *E04C 2/38* | (2006.01) |
| *E04C 2/32* | (2006.01) |
| *E06B 3/00* | (2006.01) |

(52) U.S. Cl. ..... 52/784.1; 52/783.12; 52/800.1; 49/501

(58) Field of Classification Search ..... 52/241, 52/783.12, 783.13, 798.1, 800.1, 781.11, 52/784.1, 784.12, 784.13, 36.1, 239; 220/1.5, 220/669; 160/135, 186, 201; 187/325, 334; 292/218; 49/197, 199, 501, 116, 117, 118
See application file for complete search history.

(56) References Cited

U.S. PATENT DOCUMENTS

| | | | | | |
|---|---|---|---|---|---|
| 1,257,476 | A | * | 2/1918 | Gervais | 52/458 |
| 1,848,715 | A | * | 3/1932 | Hart et al. | 52/784.13 |
| 2,863,503 | A | * | 12/1958 | Stroup | 160/201 |
| 3,635,156 | A | * | 1/1972 | Krebs et al. | 101/93.33 |
| 3,744,827 | A | * | 7/1973 | Cox | 403/24 |
| 3,981,102 | A | * | 9/1976 | Harwood et al. | 49/501 |
| 4,057,170 | A | * | 11/1977 | Dougherty | 220/323 |
| 4,364,203 | A | * | 12/1982 | Seaholm et al. | 49/409 |
| 4,391,019 | A | * | 7/1983 | Downes | 16/105 |
| 4,631,894 | A | * | 12/1986 | Jerila | 52/800.13 |
| 5,203,116 | A | * | 4/1993 | Chen | 49/404 |
| 5,568,712 | A | * | 10/1996 | Jenkins et al. | 49/501 |
| 6,067,768 | A | * | 5/2000 | Colussi | 52/656.2 |
| 6,079,168 | A | * | 6/2000 | Shaver | 52/202 |

(Continued)

FOREIGN PATENT DOCUMENTS

| | | |
|---|---|---|
| EP | 0 808 984 | 11/1997 |

(Continued)

OTHER PUBLICATIONS

International Search Report completed on Jul. 23, 2007 by the European Patent Office in corresponding counterpart foreign application No. EP 07004230.4-1256.

*Primary Examiner*—David Dunn
*Assistant Examiner*—Joseph J Sadlon
(74) *Attorney, Agent, or Firm*—Abelman, Frayne & Schwab

(57) ABSTRACT

An improved panel (10) for lift doors, made of metal or another suitable material, including a plate (12) in a basically rectangular shape, whose longer sides extend in height and are folded back with a "C"-shaped profile in the longitudinal direction to form opposed edges or rims (14) turned towards the longitudinal axis of the plate itself, the lower base of the latter being equipped with a basically "S"-shaped back fold including a horizontal flat portion (22) along which a plurality of fissures (24) are made which receive a portion of the lower edge of one or more stiffening members (36).

22 Claims, 3 Drawing Sheets

U.S. PATENT DOCUMENTS

| | | | | |
|---|---|---|---|---|
| 6,381,917 | B1 * | 5/2002 | Thielow et al. | 52/784.1 |
| 6,385,942 | B1 * | 5/2002 | Grossman et al. | 52/798.1 |
| 6,494,001 | B1 * | 12/2002 | Ketonen et al. | 52/204.1 |
| 6,718,717 | B2 * | 4/2004 | Henderson et al. | 52/474 |
| 6,988,592 | B2 * | 1/2006 | Watabe et al. | 187/313 |
| 2001/0027621 | A1 * | 10/2001 | Davies et al. | 49/360 |

FOREIGN PATENT DOCUMENTS

| | | | |
|---|---|---|---|
| EP | 1 083 290 | | 3/2001 |
| EP | 1 418 150 | | 5/2004 |
| FR | 2 685 313 | | 6/1993 |
| GB | 2326662 | A * | 12/1998 |
| JP | 2004 018262 | | 1/2004 |

* cited by examiner

FIG. 1
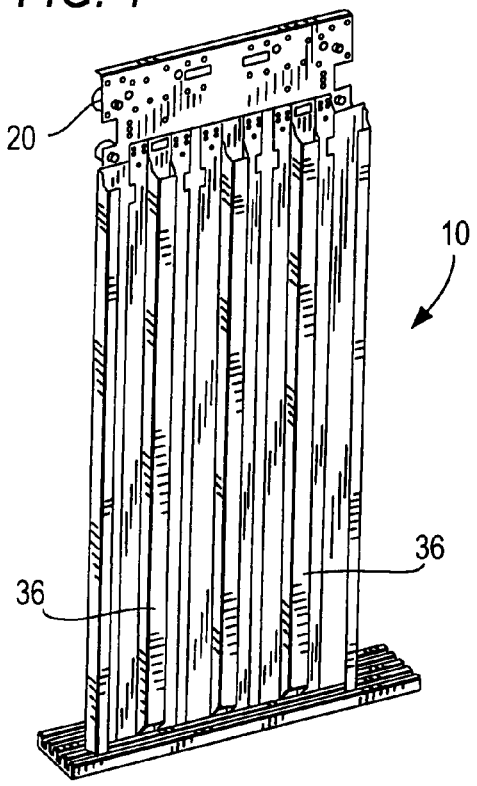
FIG. 3
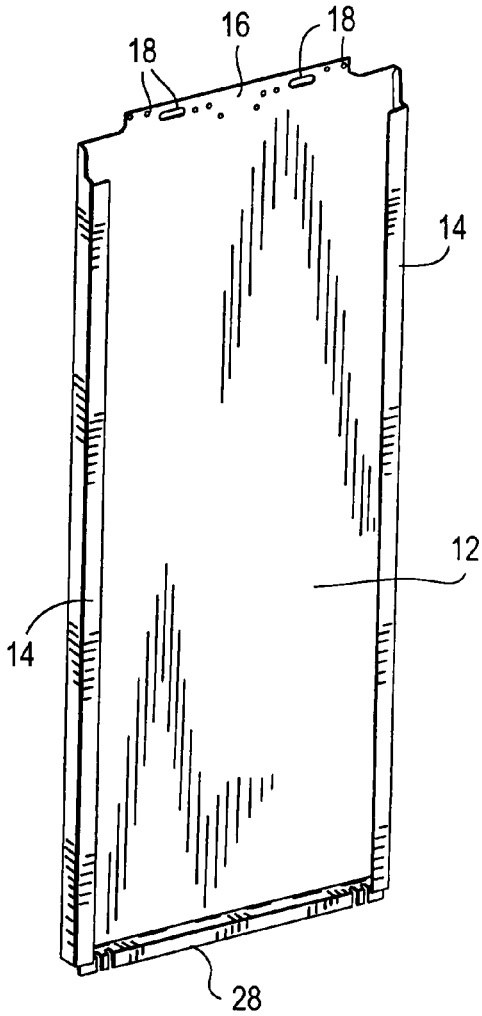
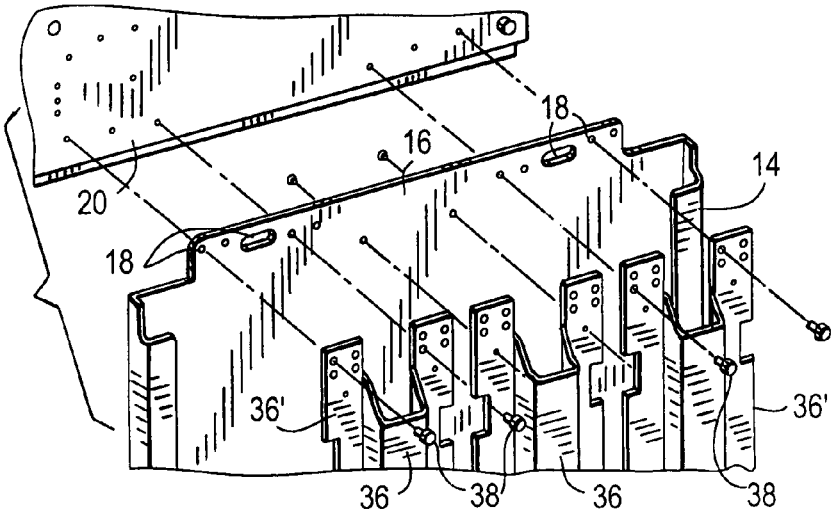
FIG. 2

PANEL FOR LIFT DOORS

TECHNICAL FIELD

This invention refers to an improved panel for lift doors.

More particularly, this invention refers to a panel for lift doors where different parts are easily assembled to one another in a simple and quick manner and include incorporated devices fit for connection to other parts of the lift system.

BACKGROUND ART

It is known that the shutters making up the lift doors are typically composed of rolled sections or bearing frames for various types of covering; these panels are coupled in the upper portion to shaped plates whereon the sliding carriages or part of them are fastened. These shaped plates are traditionally bound to the panels by means of bonded joints or, in any case, using permanent fastening means that entail troublesome and, hence, expensive operations.

The very shutter panels require the presence, on the opposite lower front, of further plates forming the bearing of the traditional shoes that slide in the sill grooves or races.

Even in this case, the mentioned shoe bearing plates are generally fastened to the panel by bonded joints or equivalent means, similarly to the plates that are meant to fasten the carriage.

The known panels, furthermore, are sometimes equipped with stiffening members in the form of metal rolled sections of various shapes and sizes, which also require troublesome assembling operations, that is for a stable connection to the mentioned panels.

All considered, the manufacture of each panel according to the known art involves a number of operations, part of which are manual, which are very expensive and demand long manufacturing time.

DISCLOSURE OF INVENTION

The object of this invention is to remedy the drawbacks listed above. More particularly, the object of this invention is to provide a panel for lift door shutters that incorporate both means for connecting the carriage to the upper portion and means for bearing the shoes that slide in the sill in the lower portion.

A further object of this invention is to provide a panel as defined above, which is fit to be easily and quickly coupled to stiffening members.

A further object of this invention is to make available to users an improved panel for lift doors that is such as to allow a high level of resistance and reliability over time, also such as to be easily and cheaply manufactured.

These and other objects are achieved by the improved panel for lift doors according to claim 1.

BRIEF DESCRIPTION OF THE DRAWINGS

The structural and functional characteristics of the improved panel for lift doors of this invention can be better understood from the description that follows, wherein reference is made to the attached drawings that provide a preferential embodiment which is not meant to be restrictive, and wherein:

FIG. 1 is a schematic perspective view of the panel of this invention, assembled in all its various parts and coupled, on the top, to a carriage bearing shaped plate and, at the bottom, to the sill wherein the shoes slide;

FIG. 2 is a schematic exploded perspective view of an enlarged detail of the upper portion of the panel according to FIG. 1;

FIG. 3 is a schematic perspective view of the same panel in a condition that is prior to any connection to other parts;

Figure 4A:
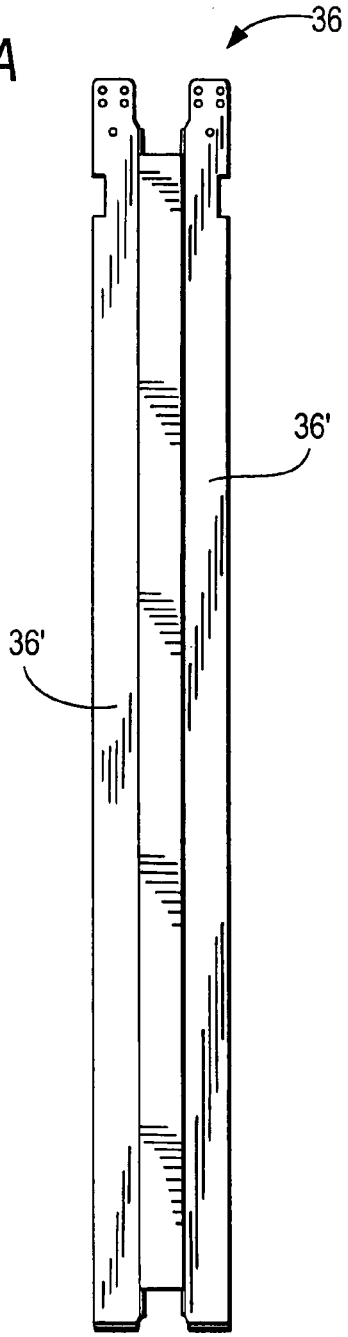
FIG. 4A is a front elevational view of a stiffening member that can be applied to the panel of this invention.
Figure 4B:
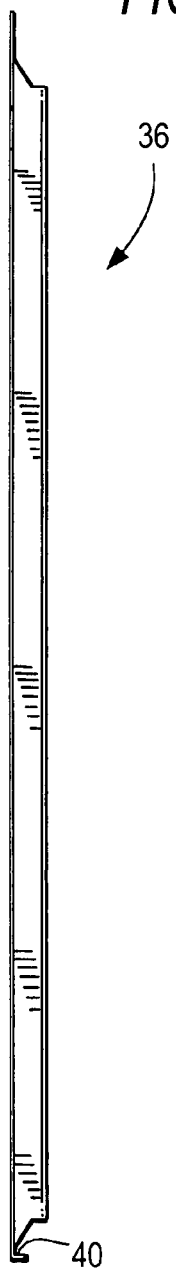
FIG. 4B is a side elevational view of the stiffening member according to FIG. 4A.

With reference to the above-listed figures, the improved panel for lift doors of this invention is marked, on the whole, with reference 10 in FIG. 1, wherein it is depicted in its fully assembled form. This panel includes a plate 12, basically rectangular in shape, whose longer sides extend in height with the edges folded back in the shape of a "C" in the longitudinal direction for almost the entire extension in height of the very sides; these back folds are turned in the direction of the longitudinal axis and opposed to one another, to form as many edges or rims 14. In the upper portion the plate 12 extends to a central appendage 16 featuring a planar development, along which a plurality of through hollows or openings 18 of adequate shape and size are formed, which are meant to receive screws, bolts or equivalent means that fasten the bearing frame 20 of the traditional shutter handling carriage of the lift system to the plate, as schematized in FIG. 1.

Figure 6:
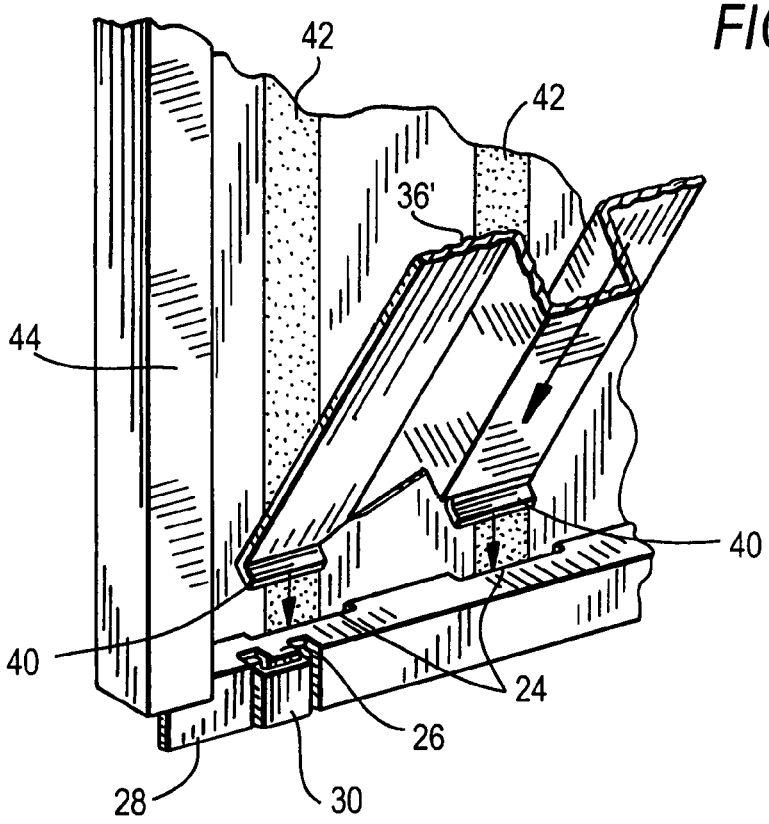
FIG. 6 is a schematic exploded perspective view of an enlarged detail of the panel and of a stiffening member that is coupled to it.
Figure 7:
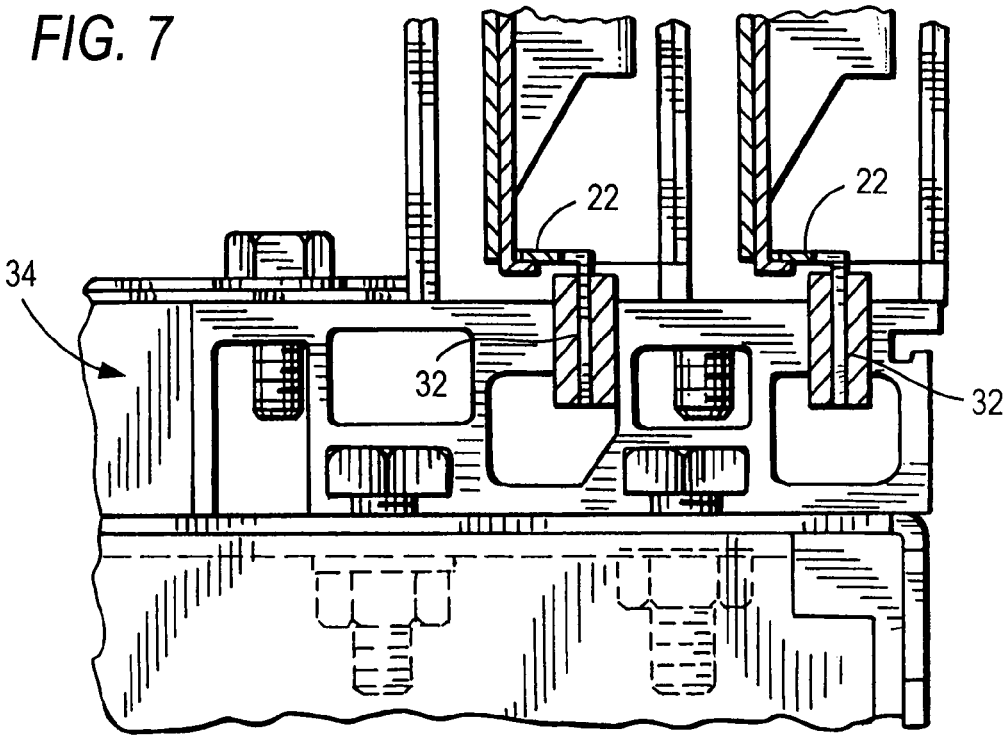
FIG. 7 is a partially section schematic view of a detail of the lower portion of the panel of this invention equipped with shoes that slide in the sill.

The lower portion of the plate 12, opposed to the central appendage 16, is delimited by edges 14 and is folded back with a basically "S"-shaped course, as specially highlighted in FIG. 6. The horizontal flat portion of this "S"-shaped back fold is marked with 22 in FIG. 7 and is equipped with a plurality of fissures 24 aligned to one another and spaced, whose function is to receive part of the lower edge of the stiffening members that will be described hereinafter. Along the same horizontal flat portion 22 of the "S"-shaped back fold formed at the base of the plate 16 also at least one shaped aperture 26 is obtained, which partly extends along the adjoining vertical portion, marked with 28 in FIG. 6, of the mentioned "S"-shaped back fold. Each of the openings 26 is pre-arranged to receive the knows sliding shoes 30 which are connected by known means to the mentioned vertical portion 28 and slide along seats 32 of the traditional sill, marked on the whole with reference 34 in FIG. 7.

As hinted at above, the panel of this invention can be advantageously associable to a stiffening member, or to a plurality of stiffening members, all like each other, like those marked with reference 36 in FIGS. 1, 2, 5, 6, 7.

Each of these stiffening members, made of metal plate or another suitable material, is illustratively folded back according to a "U" profile which extends to integral and opposed side areas featuring a planar development, equipped at least at the upper end of through openings and or hollows for as many bolts 38 for fastening to the plate 12.

Figure 5A:
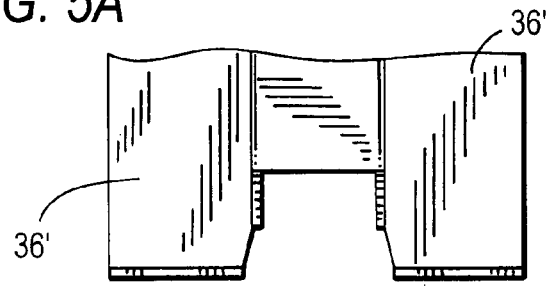
FIG. 5A is an enlarged detail view of the lower portion of the stiffening member according to FIGS. 4A and 4B.
Figure 5B:
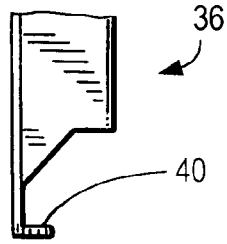
FIG. 5B is an enlarged side elevational view of the lower portion of the stiffening member according to FIG. 5A.

According to a further advantageous characteristic of this invention, each of the stiffening members 36 is equipped, at the lower end portion, of one or more extensions 40, specially visible in FIGS. 5 and 6, which are intended to fit into fissures 24 of the "S"-shaped back fold made at the base of the plate 12. Preferably, extensions 40 are made along each of the side areas, marked with 36', of the stiffening members 36 and are basically folded back by 90° outwards, that is in the opposite direction as to the plate 12.

As schematized in the figures, each of the stiffening members 36 is coupled to the sheet 12 through the extensions 40 inserted into the fissures 24 and through the bolts 38 or the like items located by the holes obtained at least on the upper portion of the members. In addition to these fastening means, or for a partial or total replacement of the mentioned bolts, the use of adhesive material is envisaged, in the form of strips 42 applied with any suitable means along at least a portion of the plate 12, aligned with the side areas 36' of one or more stiffening members 36.

The latter, which mainly lend the panel 10 mechanical rigidity and fire resistance, are preferably slightly spaced from one another; Moreover, it must be envisaged that, once applied to the plate 12, the stiffening members 36 may turn out to be next to one another.

As one can infer from the foregoing description, the advantages achieved by the invention are obvious.

The improved panel for lift doors of this invention advantageously incorporates means for connection to the carriage bearing 20, composed of the upper appendage 16 of the plate 12, which avoids having to resort to bonded joints or complicated systems to bind the bearing. Moreover, the back folding mainly in the shape of an "S" of the opposite lower portion of the plate 12, allows the shoes 32 to be lodged to slide in the sill 34 and advantageously includes fissures 24 which allow to stabilize, at least in part, the stiffening members 36. Therefore, the latter members prove to be easily united to the plate 12, even in anticipation of the use of adhesive strips or materials 42. On the whole, the panel thus manufactured is characterized by a considerable strength and allows remarkable saving both in terms of time and cost-effectiveness to assemble the carriage bearing in the upper portion and the sliding shoes in the lower portion.

Although the foregoing disclosure has been described by making special reference to a preferential embodiment which is provided as an example but which is not meant to be exhaustive in character, all modifications and changes will be obvious to one of ordinary skill in the art in the light of the foregoing description.

Therefore, this invention shall be meant to include all those variations and changes that come under its essence and within the scope of the appended claims.

The invention is:

1. A panel (10) for lift doors, which comprises:

(a) a plate 12 having a generally rectangular shape, whose longer sides extend along the height thereof, the longitudinal edge portions being folded back in a generally "C"-shaped profile to form opposed edges or rims (14) that are turned inwardly towards the center of said plate, the lower base portion of said plate being folded to form a generally horizontal flat portion (22) and a generally vertical portion (28) extending downwardly from said flat portion (22), and (b) a plurality of separate stiffening members (36), each said stiffening member being provided with an extension (40) along the lower edge thereof, said horizontal flat portion (22) of said lower base portion of said plate (12) including a plurality of apertures in which said extensions (40) are respectively inserted, each said stiffening member (36) being formed according to a "U"-shaped profile with integrally extended and opposed side areas featuring a planar development, each said stiffening member (36) being provided at least at its upper end with a plurality of through openings or hollows for fastening both said stiffening member (36) and a bearing frame (20) of a lift shutter handling carriage together to said plate (12) by means of bolts (38).

2. A panel according to claim 1, characterized in that said plate (12) extends at the top into an integral central appendage (16) featuring a planar development along which said plurality of through openings (18) or hollows are formed.

3. A panel according to claim 1, characterized in that said horizontal flat portion (22) of said lower base of said plate (12) is equipped with one or more shaped openings (26) which at least partially extend along the adjoining vertical portion (28) of the back fold and receive sliding shoes (30) that slide along seats (32) of a sill (34), said shoes (30) being connected to said vertical portion (28) of said lower base of said plate (12).

4. A panel according to claim 2, characterized in that said flat portion (22) of said lower base portion of said plate (12) is equipped with one or more shaped openings (26) which partially extend along the adjoining vertical portion (28) of said lower base portion to receive sliding shoes (30) that slide along seats (32) of said sill (34), said shoes (30) being. connected to said vertical portion (28) of said lower base of said plate (12).

5. A panel according to claim 1, characterized in that said stiffening members (36) are folded back according to a "U"-shaped profile which extends into integral and opposed side areas (36'), said extensions (40) of said stiffening members being folded back by approximately 90° with respect to said side areas (36').

6. A panel according to claim 2, characterized in that said stiffening members (36) are folded back according to a "U"-shaped profile which extends into integral and opposed side areas (36'), said extensions (40) of said stiffening members being folded back by approximately 90° with respect to said side areas (36').

7. A panel according to claim 3, characterized in that said stiffening members (36) are folded back according to a "U"-shaped profile which extends into integral and opposed side areas (36'), said extensions (40) of said stiffening members being folded back by approximately 90° with respect to said side areas (36').

8. A panel according to claim 5, characterized in that said stiffening members (36) are additionally fastened to said plate (12) by means of an adhesive material in the form of continuous or discontinuous strips (42).

9. A panel according to claim 6, characterized in that said stiffening members (36) are additionally fastened to said plate (12) by means of an adhesive material in the form of continuous or discontinuous strips (42).

10. A panel according to claim 6, characterized in that said stiffening members (36) are additionally fastened to said plate (12) by means of an adhesive material in the form of continuous or discontinuous strips (42).

11. A panel according to claim 6, characterized in that said stiffening members (36) are additionally fastened to said plate (12) by means of an adhesive material in the form of continuous or discontinuous strips (42).

12. A panel (10) for lift doors comprising:

(a) a plate (12) in a rectangular shape, whose longer sides extend alone the height thereof, the longitudinal edge portions thereof being folded back to form a "C"-shaped profile along the longitudinal direction to form opposed edges or rims (14) that are turned inwardly towards the central longitudinal axis of said plate, the lower base portion of said plate being equipped with a back fold that is generally "S"-shaped and including a horizontal flat portion (22), and (b) a plurality of separate stiffening members (36), attached to said plate, each said stiffening member provided with an extension (40) along the lower edge thereof, characterized in that said horizontal flat portion (22) of said plate is formed with a plurality of apertures (24) into which said extensions (40) provided along the lower edge of said stiffening members (36) are inserted, and in that each said stiffening member (36) is formed according to a "U"-shaped profile with integrally extended and opposed side areas having planar surfaces, each said stiffening member (36) being provided at least at its upper end with a plurality of through openings (18) for fastening both said stiffening member (36) and a bearing frame (20) of a lift shutter handling carriage to said plate (12) by means of bolts (38).

13. A panel according to claim 12, characterized in that said plate (12) extends at the top into an integral central appendage (16) featuring a planar development along which said plurality of through openings (18) or hollows are formed.

14. A panel according to claim 12, characterized in that said flat portion (22) of the "S"-shaped back fold of the plate (12) is equipped with one or more shaped openings (26) which partially extend along the adjoining vertical portion (28) of the back fold itself and receive sliding shoes (30) that slide along the seats (32) of a sill (34), said shoes (30) being connected to said vertical portion (28) of the "S"-shaped back fold of the plate (12).

15. A panel according to claim 13, characterized in that said flat portion (22) of the "S"-shaped back fold of the plate (12) is equipped with one or more shaped openings (26) which partially extend along the adjoining vertical portion (28) of the back fold itself and receive sliding shoes (30) that slide along the seats (32) of a sill (34), said shoes (30) being connected to said vertical portion (28) of the "S"-shaped back fold of the plate (12).

16. A panel according to claim 12, characterized in that said stiffening members (36) are folded back according to a "U"-shaped profile which extends into integral and opposed side areas (36') and that said extensions (40) are folded back by 90° towards the side areas (36').

17. A panel according to claim 13, characterized in that said stiffening members (36) are folded back according to a "U"-shaped profile which extends into integral and opposed side areas (36') and that said extensions (40) are folded back by 90° towards the side areas (36').

18. A panel according to claim 14, characterized in that said stiffening members (36) are folded back according to a "U"-shaped profile which extends into integral and opposed side areas (36') and that said extensions (40) are folded back by 90° towards the side areas (36').

19. A panel according to claim 16, characterized in that said stiffening members (36) are additionally fastened to said plate (12) by means of an adhesive material in the form of continuous or discontinuous strips (42).

20. A panel according to claim 17, characterized in that said stiffening members (36) are additionally fastened to said plate (12) by means of an adhesive material in the form of continuous or discontinuous strips (42).

21. A panel according to claim 18, characterized in that said stiffening members (36) are additionally fastened to said plate (12) by means of an adhesive material in the form of continuous or discontinuous strips (42).

22. A panel (10) for lift doors, which comprises:

(a) a plate 12 having a generally rectangular shape, whose longer sides extend along the height thereof, the longitudinal edge portions being folded back in a generally "C"-shaped profile to form opposed edges or rims (14) that are turned inwardly towards the center of said plate, the lower base portion of said plate being folded to form a generally horizontal flat portion (22) and a generally vertical portion (28) extending downwardly from said flat portion (22), and (b) a plurality of separate stiffening members (36), each said stiffening member being provided with an extension (40) bent at 90 degrees to said stiffening member and extending along the lower edge thereof, said horizontal flat portion (22) of said lower base portion of said plate (12) including a plurality of apertures in which said extensions (40) are respectively inserted so as to face the underside of said horizontal flat portion in face-to-face relation, each said stiffening member (36) being formed according to a "U"-shaped profile with integrally extended and opposed side areas featuring a planar development, each said stiffening member (36) being provided at least at its upper end with a plurality of through openings or hollows for fastening both said stiffening member (36) and a bearing frame (20) of a lift shutter handling carriage together to said plate (12) by means of bolts (38).

* * * * *